US005469658A

United States Patent [19]

Digianni et al.

[11] Patent Number: 5,469,658

[45] Date of Patent: Nov. 28, 1995

[54] LOUVRE SHUTTER DEVICE WITH VARIABLE SLATS

[76] Inventors: Michele Digianni, 32 Pennycross Court; Norbert Marocco, 46 Pennycross Court, both of Woodbridge, Ontario, Canada, M4L 3M6

[21] Appl. No.: 35,036

[22] Filed: Mar. 22, 1993

[30] Foreign Application Priority Data

Mar. 20, 1992 [CA] Canada ..... 2063632

[51] Int. Cl.[6] ..... E05B 7/08

[52] U.S. Cl. ..... 49/82.1; 49/74.1; 160/176.1

[58] Field of Search ..... 49/82.1, 74.1, 49/87.1; 160/176.1 V, 172 V, 134; 454/221, 224, 278

[56] References Cited

U.S. PATENT DOCUMENTS

| | | | |
|---|---|---|---|
| 361,019 | 4/1887 | Morstatt | 49/84 |
| 425,542 | 4/1890 | Hantsche | 454/224 X |
| 842,969 | 2/1907 | Ostermann | 160/134 |
| 1,015,144 | 1/1912 | Daly | 49/403 |
| 1,613,364 | 1/1927 | Thompson | 160/134 X |
| 1,830,487 | 11/1931 | Samberg | 49/84 |
| 2,524,373 | 10/1950 | Bopp et al. | 160/176.1 V |
| 3,110,936 | 11/1963 | Berard et al. | 160/236 X |
| 3,368,798 | 2/1968 | Kusel et al. | 256/65 |
| 3,783,768 | 1/1974 | Caming et al. | 98/121.2 X |
| 3,991,518 | 11/1976 | Ishihara | 49/84 X |
| 4,102,381 | 7/1978 | Bratschi | 160/176.1 V X |
| 4,275,762 | 6/1981 | Field | 98/121.2 X |
| 4,643,081 | 2/1987 | Vicinanza et al. | 98/121.2 X |
| 4,850,138 | 7/1989 | Watanabe et al. | 49/84 |
| 4,951,925 | 8/1990 | Schultz et al. | 256/65 |
| 4,991,823 | 2/1991 | Stanish, Jr. | 256/65 X |
| 5,187,896 | 2/1993 | Ross | 49/74.1 |
| 5,216,837 | 6/1993 | Cleaver et al. | 49/82.1 |

FOREIGN PATENT DOCUMENTS

| | | | |
|---|---|---|---|
| 52173 | 5/1982 | European Pat. Off. | 49/403 |
| 635535 | 3/1928 | France | 49/82.1 |
| 2514701 | 10/1976 | Germany | 160/134 |

*Primary Examiner*—Peter M. Cuomo
*Assistant Examiner*—Jerry Redman

[57] ABSTRACT

A louvre shutter or door, of a type having a rectangular frame work, consisting of side frames and top and bottom frames, and slats extending from side to side and hollow extrusions forming the side frames, defining inner walls and outer walls, and side walls pivots at each end of the slats, recesses in the inner walls the side frames, with pivot of the slats extending through respective recesses, gears secured to the pivots extending through recesses in one of the side frames, and, a rack interconnecting the gears so that movement of one of the slats, will be transmitted to all of the slats. Also disclosed is a louvre shutter for a fanlight with wedge shaped slats, having a variable profile.

13 Claims, 4 Drawing Sheets

LOUVRE SHUTTER DEVICE WITH VARIABLE SLATS

FIELD OF THE INVENTION

The invention relates to louvre shutters or doors such as are used for doors, windows and the like, having slats, and in particular, to such a louvre door wherein the slats can be spaced varying distances apart, in different doors, and to a louvre shutter for a fanlight.

BACKGROUND OF THE INVENTION

Louvre shutters and doors, generally comprising a rectangular frame, with horizontal louvre slats, extending from side to side are well known. Typically, such louvre slats are simply pivoted at each end in the frame. They are moved together in unison by means of a rod, fastened to each slat by a movable coupling. When the rod is moved all the slats moving in unison.

Numerous designs of such doors are available in wood. However, in order to provide a longer life and a better resistance to weathering, it is preferable to manufacturer the doors and shutters out of thermo-plastic material. Many such plastic louvre door designs are now available, using hollow extrusions for the frames and extrusions for slats. However, the construction of such plastic louvre doors has generally speaking, followed the design of wooden louvre doors. In such plastic louvre doors the slats were simply pivoted between the side frames of the door. A central control rod was movably linked to each of the slats at their edges, and the slats simply pivoted to and fro in this way. The construction and design of the frames and the way which they were secured together were relatively crude and the attachment of hinges to such doors was somewhat fragile.

In particular, however, the design of the frames and slats and the single control rod were such that the slats were obliged to be located at a fixed predetermined spacing along the side frames. It is, however, well-known that such doors must be cut to fit the particular size of door or window in the house, so that the dimensions of the frame will vary somewhat from top to bottom, from one house to another. The variation in frame height, in the prior plastic doors, was achieved simply by cutting off a portion of the top or bottom frames of the door. This practice would remove one of the edges of the extrusion from which the top and bottom frames were made. This would then have to be replaced by cap strips. The end result would produce a somewhat weaker frame. In some cases only one end of a frame would be cut, so the end frames would be for example wider at the bottom and narrower on the top.

For all these reasons, it is desirable to provide an improved form of louvre shutter or door, in which the slats are linked together in such a way that they may be located with varying spacings in varying sizes of doors.

BRIEF SUMMARY OF THE INVENTION

With view to providing a louvre shutter construction which overcomes foregoing problems, the invention comprises a louvre shutter, of a type having a rectangular framework, consisting of side frames and top and bottom frames, and slats extending from side to side of the side frames, and said louvre shutter comprising hollow extrusions forming said side frames, defining inner walls and outer walls, and side walls therebetween, said slats defining two ends, and pivot means at each said end, recess means in the inner wall of a first side frame member, corresponding registering recess means in the inner wall of the second said side frame member, said pivot means of said slats extending through respective said recess means in respective said first and second inner walls, gear members secured to said pivot means extending through said recess means in said second one of said side frames, and, rack means interconnecting said gear means, whereby movement of one of said slats, will be transmitted to all of said slats, whereby all of said slats will pivot in unison with one another.

The invention further comprises such a louvre shutter and wherein the gear members are secured to their respective slats by moveable means, whereby said gear members may be secured in any desired orientation relative to respective said slats.

The invention further comprises such a louvre shutter and wherein said gear members comprise generally cylindrical internal sleeves, and externally directed gear teeth, and wherein said pivot means on said slats comprise generally cylindrically shaped pivot arms extending from said slats, said pivot arms making a sliding rotational fit within said cylindrical interior surfaces of said gear members.

The invention further comprises such a louvre shutter, and wherein wedge means are adapted to be forced into said pivot arms, whereby to expand the same within said gear members, and cause binding frictional engagement, thereby fixing said gear members to said pivot arms.

The invention further comprises such a louvre shutter, and including opening means in said outer wall of said second side members of said frame means registering with said recesses in said inner wall and of larger cross section than said recesses in said inner wall, thereby giving access to the ends of said pivot arms, for insertion of said wedge means therein.

The invention further comprises such a louvre shutter, and including cover plate means, adapted to be snap fitted onto said side frame members, and covering said opening means in said second side frame members.

The invention further comprises such a louvre shutter and including operating means attached to said rack means, and extending outwardly from said second side frame member, for manual operation of said rack means.

The invention further comprises a louvre shutter for covering an opening of generally arcuate shape, and including an inner arcuate frame portion of a first radius, an outer arcuate frame portion of a second radius, and slats extending between said first and second arcuate frame portions, and wherein said slats comprise a first fixed slat portion, and at least two second moveable slat portions, said moveable slat portions being hingedly mounted on opposite sides of said fixed slat portion, and being swingable relative thereto between retracted and extended positions, and in said extended positions, defining in profile a generally wedge shaped slat in elevation, being narrower at its inner radial end, and wider at its outer radial end.

The invention further comprises such a louvre shutter, and wherein said slat side members are moveable relative to said fixed members, and including movement means for moving the same towards and away from said center member.

The invention further comprises such a louvre shutter and wherein said center members are rotatable relative to said inner and outer radial frame members, and including means at one end of said slats, operable to rotate said slats relative to said radial members.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrate and described preferred embodiments of the invention.

IN THE DRAWINGS

FIG. 1 is a perspective illustration of a louvre shutter in accordance with the invention, shown partially cut away to reveal its construction;

FIG. 2*a* is an elevation of a louvre shutter of FIG. 1, showing a first slat spacing;

FIG. 2*b* is an elevation corresponding to FIG. 2*a* showing a second slat spacing;

DESCRIPTION OF A SPECIFIC EMBODIMENT

Figure 1:
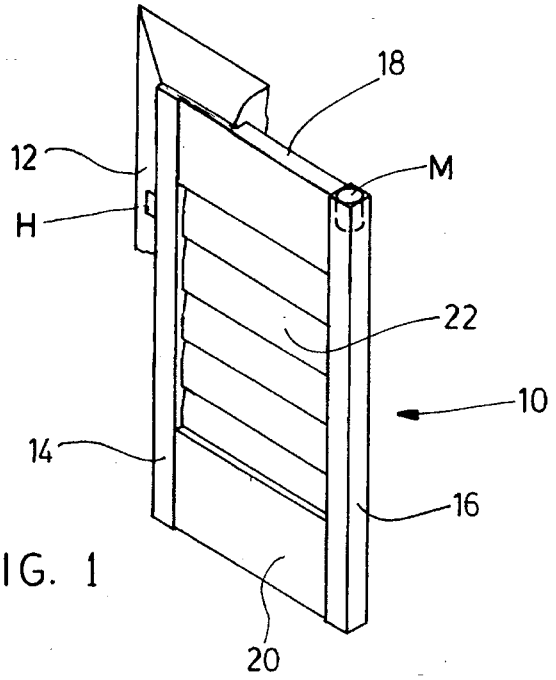

Referring first of all to FIG. 1, it will be seen that the invention is here illustrated in the form of a louvre shutter indicated generally as 10, set in a fame 12. The frame 12 will typically be secured to a dwelling in any suitable manner, by screws, received in suitable holes formed in the brick work or in the door frame of the dwelling or the window frame or the like, in a manner well known in the art, which is not illustrated here for the sake of simplicity.

The louvre shutter 10 is shown to comprise a rectangular framework consisting of side frame portions 14 and 16, and top and bottom frames 18 and 20.

Within the framework, there are provided a plurality of slats 22, which extend horizontally between the two side frames.

As is well known in this type of louvre shutter, the slats are rotatable within the frame, so as to be rotatable between open i.e. horizontal positions and closed positions in which the slats are rotated against one another.

As has been explained above, such louvre shutters are used on doorways and on windows, and as will be explained below, may also be used on fanlights, which are located over a doorway or a window opening.

In the past, such slats 22 were linked together by a central control rod (not shown). The control rod in prior art louvre shutters was simply movably secured to each of the slats, along one edge. The slats could then be operated simply by moving the control rod up or down.

Figure 3:
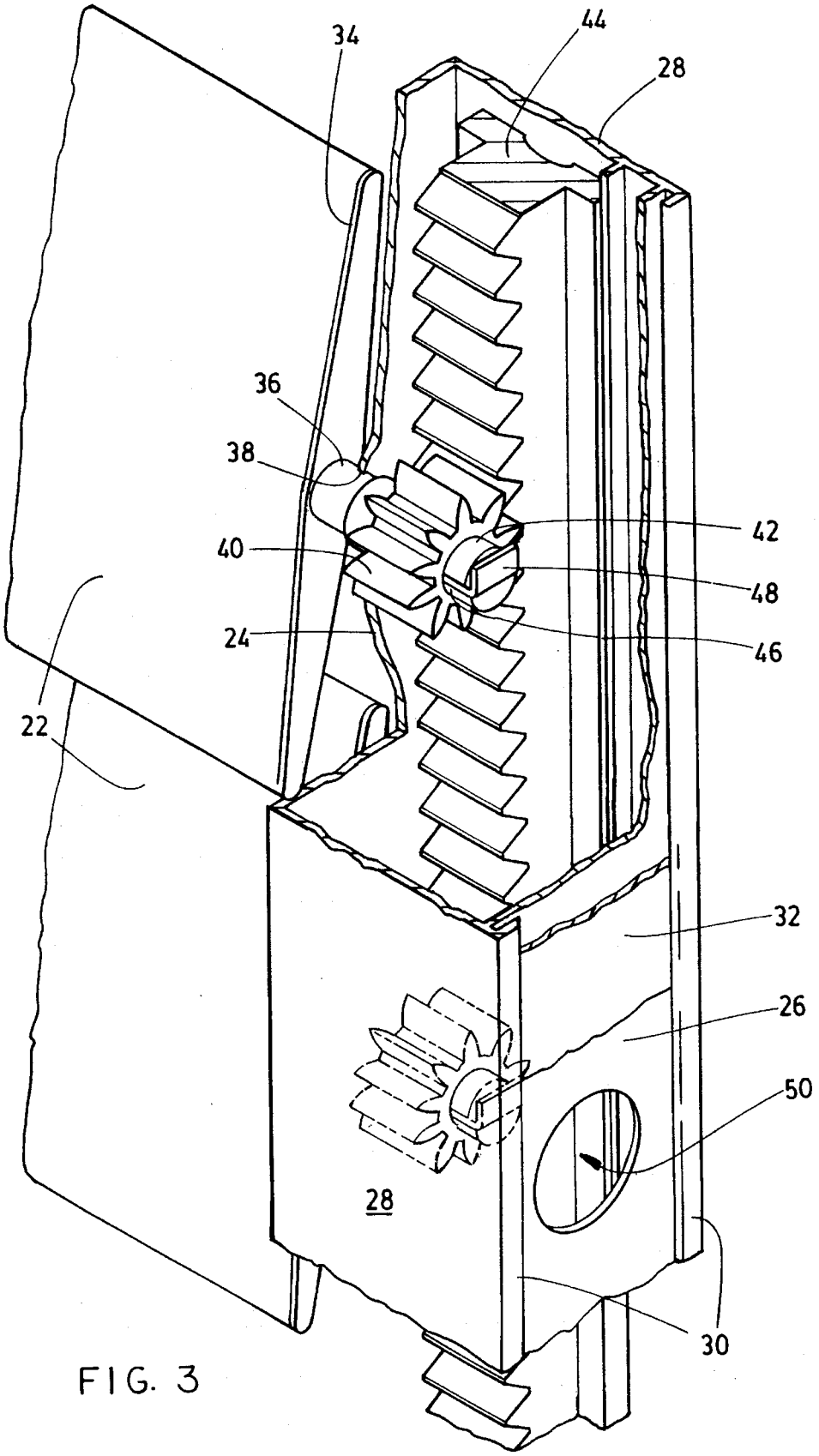
FIG. 3 is an enlarged perspective of a portion of the louvre shutter of FIG. 1, shown partially cut away.
Figure 4:
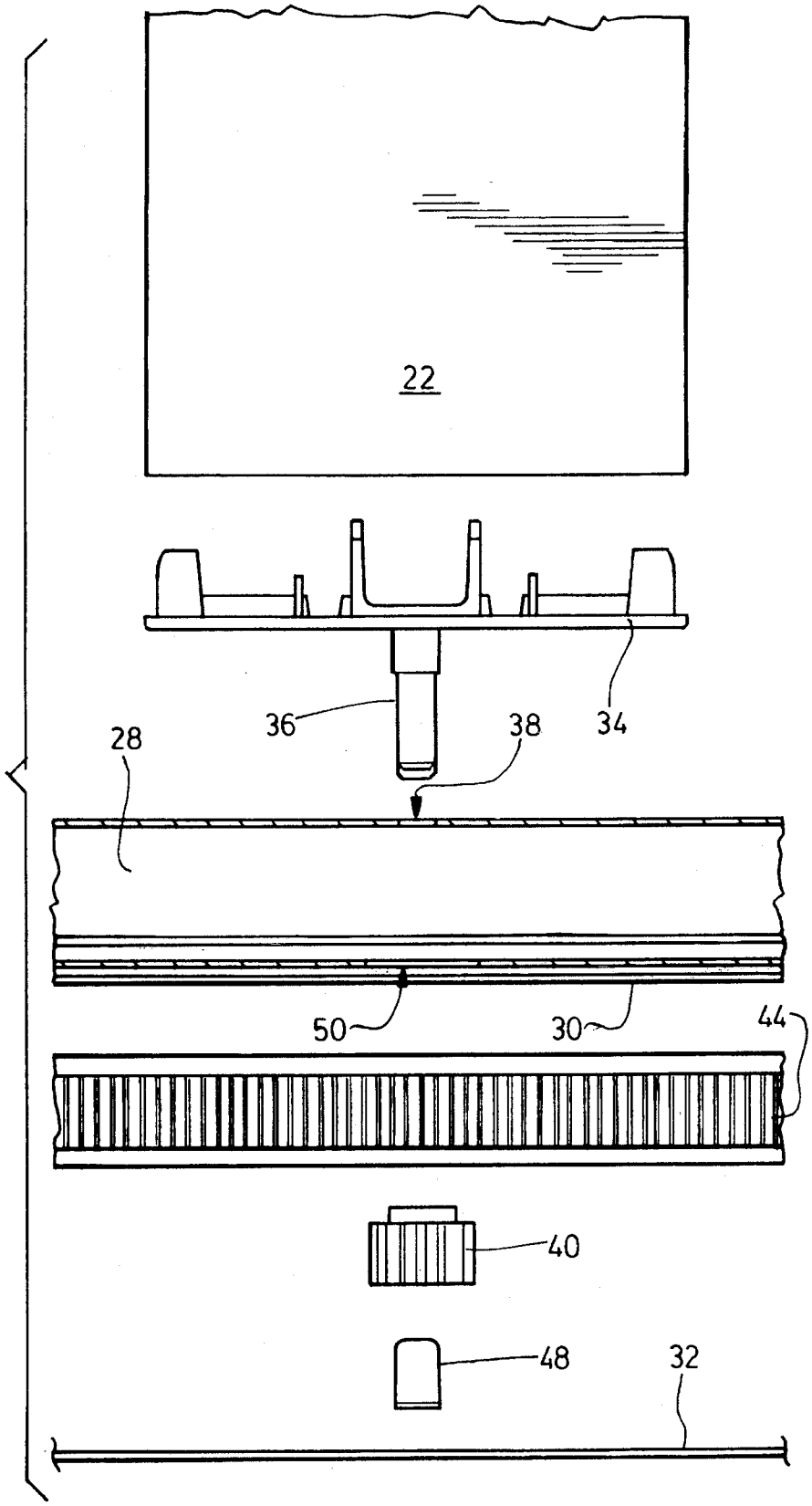
FIG. 4 is an exploded side elevational view of a portion of the shutter frame, taken along the line 4—4 of FIG. 3.

In accordance with the present invention, the slat movement means and controls are illustrated in FIGS. 3, and 4.

The side frame members 14–16 of the frame 10 are of hollow construction, and are formed of extruded plastic material, typically being vinyl material. The side frames define inner walls 24, outer walls 26 and side walls 28—28 joining the inner and outer walls. Trim walls 30—30 extend from the outer wall, for receiving a trim strip 32.

Slats 22 are formed with end formations 34, which are adapted to fit in either end of the hollow extrusion of the slats 22. The end formations 34 have pivot stub axles 36 extending from either end of the slat, and extending along the central axis thereof, enabling the same to be rotatable about the central axis, between open and closed positions. Bearing recesses 38 are formed in the inner walls of each of the side frames, at suitable intervals, in a manner to be explained below, to receive the stub axles 36.

In order to rotate all of the slats in unison, and also in order to permit the stub axles of the slats to located at variable spacings or intervals, for any particular shutter, rotational means are provided within the side frame 16, as best shown in FIG. 3. Such rotational means comprise gear members 40, having cylindrical interior recesses or openings 42 adapted to be received on the stub axles 36. The gears are interconnected by means of a rack 44, of linear design, and extending within the side frame 16. The rack 44 interengages with all of the gears 40 so that movement of any one of the slats will be communicated to all of the slats, causing them to move in unison.

Consequently, the old form of control rod, attached to the slats or louvres of the typical louvre door or shutter can be dispensed with.

The cylindrical recesses or interiors 42 of the gears 40, are sized so that they make a snug but rotational fit on their respective pivot stub axles 36 during the initial assembly of the shutter. In order to secure each gear fast on its stub axle, each stub axle is formed with an axial recess 46. A wedge 48 is forced into each axial recess in each stub axle, in order to expand the stub axle, and cause frictional binding of the stub axle within the gear. Each gear is thus fixed in relation to its respective stub axle.

Figure 2A:
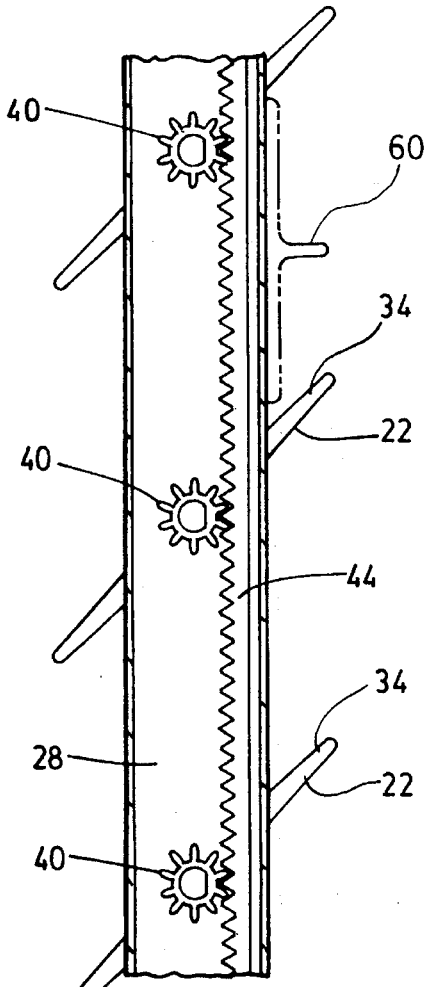
Figure 2B:
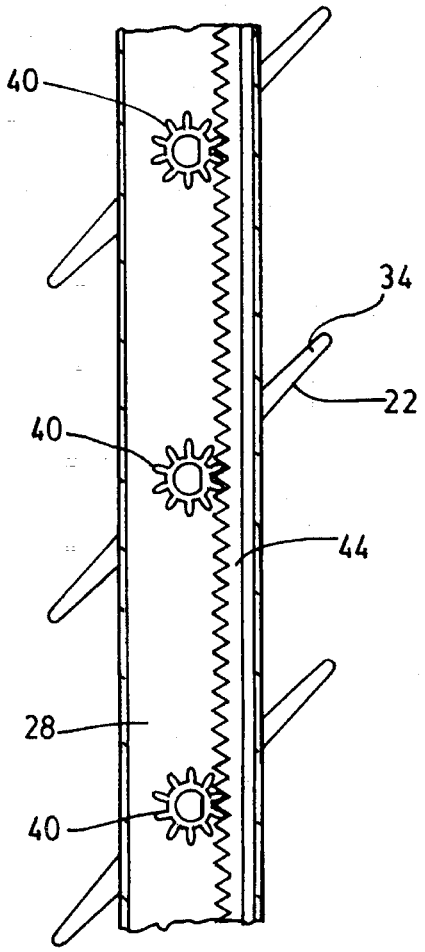

This is an important feature of the invention. It enables the bearing recesses 38 to be drilled in the side frames 14 and 16 at predetermined spaced intervals, which intervals can be varied from one shutter to another (FIGS. 2*a* and 2*b*). As explained above, the location of the individual slats in a prior art shutter was essentially fixed, by the size of the slats and the interconnection with the control rod. Consequently, in order to fit a prior art shutter on the outside of any particular dwelling, a portion of the top or bottom cross frame had to be removed in most cases. This both weakened the structure and was also unsightly since it altered the proportions of the shutter.

By the use of the present invention however the side frames can be cut to any length desired to fit any particular door or window opening. By simple computer technology, the computer will then calculate the space available between the two end frames, in which slats are to be placed. The computer will then determine the spacing between the bearing recesses 38, which is required, to hold the necessary number of slats. Such a computer may be used in accordance with well-known industrial techniques, to control an automatic multiple drilling apparatus, so that the location of the drills are then adjusted to the predetermined spacing, and all holes can then be drilled at once in one side frame, and then in the other.

In this way, the spacing between the slats can be varied from one shutter to another. Consequently, it is no longer necessary for the installer to cut off the top or bottom of the frame, since the frame is tailor-made to the particular door or window.

Referring now to FIGS. 3 and 4, it will be seen that the side frame 16 within which the gears 40 and the rack 44 are located is also provided with larger registering access openings 50, in the outer side wall of the side frame 16. In the assembly operation, the slats are first of all installed in their side frames, in their respective bearing recesses 38.

The rack 44 is then inserted in the side frame 16. All of the gears 40 are then inserted through respective access openings 50 on to their respective stub axles. The gears will also of course mesh with the teeth of the rack as they are inserted. The slats are then rotated closed and held in that position by any suitable means. The stub axles 36 will rotate within their gears, which will be fixed in position by engagement with the rack. Wedges 48 are then inserted into the axial recesses 46 in the stub axles, expanding the stub axles and causing a binding frictional engagement between the stub axles and the gears.

The end frames can then be installed and fixed between the ends of the side frames, and the trim strips 32 are then inserted in between the trim walls 30—30 to finish the exterior appearance of the side frames.

It will be observed that in this invention, since all of the slats are joined together for movement in unison by the internal concealed rack, there is no need for a control rod. All that is required is to simply move one slat and all will move in unison.

If desired however a lever 60 (FIG. 2*a*) can be connected to one of the slats or to the rack 44, and extends outwardly for example through one of the side frames.

Alternatively, the entire function may be motorized. A small electric motor indicated generally as M (FIG. 1) may be inserted at one end of the side frame 16, and connected to the rack, and operated from any suitable remote control switch (not shown).

Figure 5:
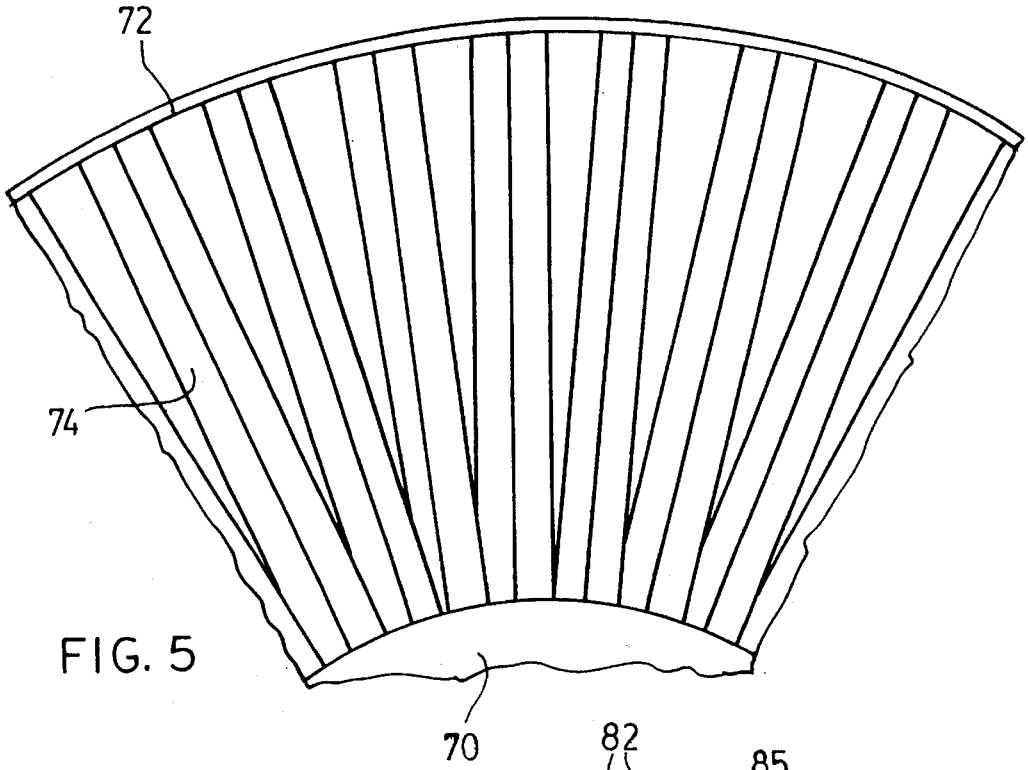
FIG. 5 is a front elevational view of an alternate embodiment of the invention.

In a further embodiment of the invention as illustrated in FIGS. 5, 6, 7 and 8, provision may be made for a louvre shutter for a fanlight. Such a louvre shutter is illustrated generally in FIG. 5 and will be seen to comprise an inner hub 70, an outer frame member 72, and a plurality of radial slats 74—74. In FIG. 5, for the sake of simplicity, only a few of the slats are shown.

It will however be appreciated that there will be a sufficient number of slats to provide one hundred percent coverage.

Figure 6:
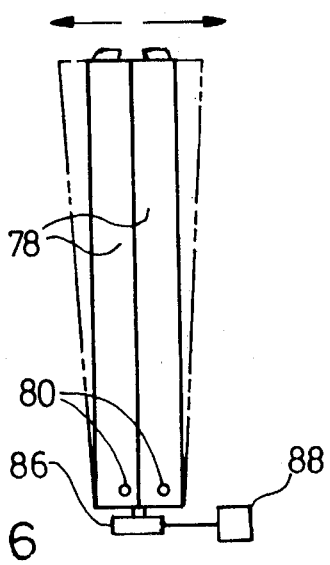
FIG. 6 is an illustration of a single slat portion of the embodiment of FIG. 5, showing two different positions, one of which is shown in phantom.
Figure 7:
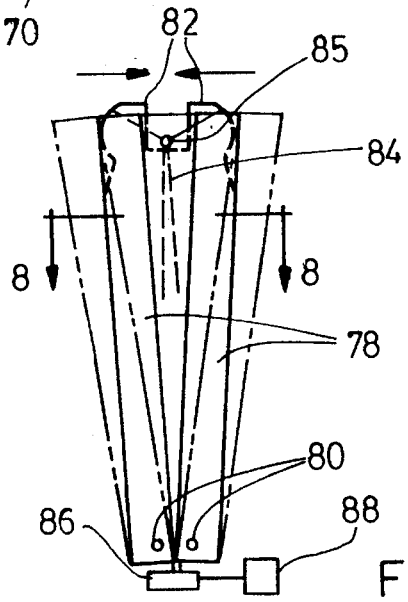
FIG. 7 is a schematic illustration of a form of mechanism for operating the embodiment of FIG. 5, and, FIG. 8 is a section along the line 8—8 of FIG. 7.

As best shown in FIGS. 6 and 7, each of the slats 74 comprises a central fixed slat portion 76, and two movable slat edge portions 78—78. The slat portions 78 are pivoted as at 80—80 to the inner radial end of the fixed slat portion.

Typically the movable edge portions will be moulded so as to make a snug sliding fit on the fixed portion.

In order to maintain the movable edge portions in their outwardly swung position, internal spring means 82 may be provided, on each side of the fixed rack slat portion.

Figure 8:
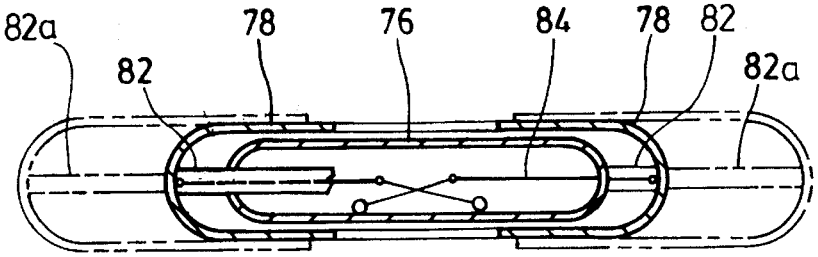

If desired, two or more such movable edge portions could be provided on each edge of the fixed portion, as shown in phantom in FIGS. 7 and 8, each provided with internal springs 82*a*.

In a further embodiment of the invention as illustrated in FIGS. 7 and 8, operating means may be provided for operating the movable edge portions, so as to contract them inwardly against the springs, or to allow them to be released and urged outward. Such operating means will be seen to comprise a pair of cords or wires 84 extending the length of the fixed slat portion 76. At the upper end of the fixed slat portion 76 the wires or cords pass through an eye 85 on spring 82 and lead outwardly and are connected to the movable edge portions 78. At the inward radial end of the fixed portion 76, a reel 86, and a motor 88 may be provided. By operating the motor, the wires or cords can either be retracted or allowed to extend.

While only one such blade having a reel and motor is illustrated, in FIG. 7, it will be appreciated that in the finished product any other suitable means of operating the movable edge portions 78 might be provided. Typically all of the operating means would be connected by flexible couplings of a type well-known in the art, and a single motor, or a hand wheel, will operate them all simultaneously.

All of the operating means and the motor would be located within the inner hub 70.

It will be appreciated that while the invention has been described as being formed of extruded plastic material the invention is equally applicable to a wooden, or a composite wooden and plastic construction. The side frames may be formed of wood, and channels may be formed in the wood for receiving the various components. Similarly, plastic channels may be formed and fitted within grooves formed in the wood to give the structure a more traditional appearance without departing from the scope of the invention.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A louvre shutter, of a type having a rectangular framework, consisting of side frames and end frames, and slats extending from side to side of the side frames, and said louvre shutter comprising;

side frames, defining inner walls and outer walls, and side walls therebetween;

slats defining two ends;

pivot means at each said end of said slats;

gear mounting portions defined said pivot means at one said end of each said slat;

opening means in respective said side frames;

gear means located in one of said side frames;

mounting recess means in said gear means for rotatably receiving respective said gear mounting portions of respective said pivot means and being dated to permit relative rotation between respective said gear means and respective said pivot means during assembly;

fastening means securing respective said gear means and respective said gear mounting portions to one another in a non-rotatable relationship, thus preventing relative rotation between respective said gear means and respective said pivot means, whereby said gear means may be initially positioned in any desired rotational orientation relative to respective said slats and thereafter non-rotatably secured relative thereto to prevent further relative rotation, and, rack means within said one of said side frames interconnecting said gear means, whereby movement of one of said slats, will be transmitted by said rack means and gear means to all of said slats, whereby all of said slats will pivot in unison with one another.

2. A louvre shutter, as claimed in claim 1 and wherein said mounting recess means comprise generally cylindrical internal recesses in said gear means and wherein said gear mounting portions comprise generally cylindrically shaped portions extending from said slats, said cylindrical portions making a sliding rotational fit within said cylindrical internal recesses.

3. A louvre shutter, as claimed in claim 2 and wherein said fastening means comprise wedge means adapted to be forced into said cylindrical portions, whereby to expand said cylindrical portions within said cylindrical internal recesses, and cause binding frictional engagement between said cylindrical portions and said gear means, thereby fixing said gear means to said cylindrical portions.

4. A louvre shutter, as claimed in claim 3 and including first opening means formed in a first said wall of said one of said side frames registering with further opening means in said other of said side walls of said side frames thereby giving access to the end of said cylindrical portions for insertion of said wedge means therein.

5. A louvre shutter, as claimed in claim 1 and including trim plate means, adapted to be snap fitted onto said frames.

6. A louvre shutter, as claimed in claim 1 and including operating means attached to said rack means, and extending outwardly from a said side frame, for manual operation of said rack means.

7. A louvre shutter as claimed in claim 1 and wherein said side frames comprise extruded channel portions, and openings formed in said channel portions for reception of said pivot means therein.

8. A louvre shutter for covering an opening of generally arcuate shape, and comprising;

an inner arcuate frame portion of a first radius;

an outer arcuate frame portion of a second radius;

a plurality of slat groups extending between said first and second arcuate frame portions, and wherein each said slat group comprises a first fixed central slat portion; a first moveable side slat portion hingedly mounted on a first side of said central slat portion;

a second moveable side slat portion on a second side of said central slat portion, said first and second side slat portions being swingable in opposite directions relative to said central slat portion between retracted and extended positions, and in said extended positions, defining in profile a generally wedge shaped slat formation in elevation, being narrower at its inner radial end, and wider at its outer radial end.

9. A louvre shutter as claimed in claim 8 and wherein said slat side portions are moveable relative to said central slat portions and including movement means for moving said slat side portions towards and away from said central slat portions.

10. A louvre shutter as claimed in claim 9 and wherein said central slat portions are rotatable relative to said inner and outer radial frame members, and including means at one end of said central slat portions operable to rotate said slat groups relative to said frame members.

11. A louvre shutter, of a type having a rectangular framework, consisting of side frames and end frames, and slats extending from side to side of the side frames, and said louvre shutter comprising side frames, defining inner walls and outer walls, and side walls therebetween;

slats defining two ends;

pivot means at each said end of said slats;

gear mounting portions defined said pivot means at one said end of each said slat;

opening means in respective said side frames;

gear means located in one of said side frames;

generally cylindrical internal recesses in said gear means, said gear mounting portions being shaped to make sliding rotational engagement within said cylindrical internal recesses;

wedge means adapted to be inserted into said gear mounting portions, to cause binding frictional engagement thereby fixing said gear means to said gear mounting portions, and, rack means within said one of said side frames interconnecting said gear means, whereby movement of one of said slats, will be transmitted by said rack means and gear means to all of said slats, whereby all of said slats will pivot in unison with one another.

12. A louvre shutter, as claimed in claim 11 and including first opening means formed i a first said wall of said one of said side frames registering with further opening means in said other of said side walls of said side frames thereby giving access to the ends of said generally cylindrical portions for insertion of said wedge means therein.

13. A louvre shutter for covering an opening of generally arcuate shape, and comprising;

an inner arcuate frame portion of a first radius;

an outer arcuate frame portion of a second radius;

a plurality of slat groups extending between said first and second arcuate frame portions, and wherein each said slat group comprises a first fixed central slat portion;

a first moveable side slat portion hingedly mounted on a first side of said central slat portion;

a second moveable side slat portion on a second side of said central slat portion, said first and second side slat portions being swingable in opposite directions relative to said central slat portion between retracted and extended positions, and in said extended positions, defining in profile a generally wedge shaped slat formation in elevation, being narrower at its inner radial end, and wide at its outer radial end, and said central slat portions being rotatable relative to said inner and outer radial frame members, and including means at one end of said central slat portions operable to rotate said slat groups relative to said frame members.

* * * * *